United States Patent [19]

Geurts

[11] Patent Number: 4,711,444

[45] Date of Patent: Dec. 8, 1987

[54] SHEET SORTING DEVICE

[75] Inventor: Petrus A. M. Geurts, Helden, Netherlands

[73] Assignee: Oce-Nederland B.V., Venlo, Netherlands

[21] Appl. No.: 844,883

[22] Filed: Mar. 27, 1986

[30] Foreign Application Priority Data

Mar. 29, 1985 [NL] Netherlands ..... 8500929

[51] Int. Cl.[4] ..... B65H 39/10

[52] U.S. Cl. ..... 271/290; 271/200; 271/292; 271/302

[58] Field of Search ..... 271/273, 274, 263, 259, 271/265, 288, 289, 290, 292, 302, 303, 305, 200

[56] References Cited

U.S. PATENT DOCUMENTS 3,944,217 3/1976 Greene ..... 271/289
4,299,382 11/1981 Ichikawa ..... 271/273 X
4,352,490 10/1982 Hatakeyama ..... 271/303 X

FOREIGN PATENT DOCUMENTS 57-161 4/1982 Japan ..... 271/287
1583168 1/1981 United Kingdom ..... 271/273

*Primary Examiner*—Richard A. Schacher
*Attorney, Agent, or Firm*—Reed Smith Shaw & McClay

[57] ABSTRACT

A sheet sorting device for use in a sheet processing machine having at least one sorting unit including a plurality of superposed sheet receiving bins and a first conveyor for conveying sheets selectively to one of the sheet receiving bins and a second conveyor positioned below and substantially normal to the first conveyor for conveying sheets from the processing machine to the first conveyor. The second conveyor is mounted to the sorting unit so as to be displaceable between a first position disposed below said receiving bins and a second position adjoining said sheet processing machine.

8 Claims, 4 Drawing Figures

SHEET SORTING DEVICE

FIELD OF THE INVENTION

The invention relates to a means for sorting sheets and, in particular, to a sheet paper sorting device for use in processing machines.

BACKGROUND OF THE INVENTION

Sheet sorting devices are generally well known and used with processing machines such as copy machines, e.g., Offenlegungsschrift DE No. 3141615 A1. For example, sorting devices having a number of receiving bins for selectively receiving sheets of paper in a predetermined order. Conventionally, the sheets are delivered to the bins by a conveyor means.

Illustrative of this type of device is the sorting and collating apparatus shown and described in U.S. Pat. No. 3,944,217.

The device described herein comprises a number of sorting units each of which has a conveyor system provided with a diverting means for selectively directing a sheet into one of the receiving bins. A fixed conveyor system extends from a sheet processing machine to the sorting units to beneath the sorting units. The fixed conveyor is provided with diverting means for selectively directing a sheet into one of the sorting units. A sheet tray is provided next to the conveyor path and extends from the sheet processing machine to the sorting units so that sheets can be collected unsorted in the tray. A diverting means in the conveyor path is controllable to set to feed sheets in said sheet tray, e.g., if a malfunction occurs in another part of the sorting device.

When the sheet sorting device described in U.S. Pat. No. 3,944,217 is located next to a sheet processing machine provided with a receiving tray for finished or processed sheets, the receiving tray in the sheet processing machine is rendered inoperative. If the part of the sheet sorting device that directly joins the sheet processing machine becomes inoperative, the entire sheet sorting device must be removed from the sheet processing machine so that the latter, together with the collecting tray associated with the processing machine, can be used. This is a disadvantage particularly in the case of sorting devices which have a large number of and/or large receiving bins, and are therefore heavy.

It is an object of the invention to provide a sorting device which overcomes the aforementioned disadvantage.

SUMMARY OF THE INVENTION

Generally, the present invention is directed to a sorting device applicable for use in processing apparatus such as photocopiers which comprises a sorting unit having a plurality of superposed sheet receiving bins and a first conveyor for selectively feeding the conveyed sheets into one of the receiving bins. A second conveyor is provided for conveying the sheets from the processing apparatus to the first conveyor. The second conveyor includes an operative and inoperative position, that is, the second conveyor system is displaceable between a first, inoperative position in which it is situated completely below the sorting unit and a second, operative position in which it adjoins the sheet processing machine.

As a result, if a malfunction occurs in the sheet sorting device, the sorter and the sheet processing machine can be readily disconnected. Disconnection is achieved by moving the second conveyor system from the second, operative position into the first, inoperative position, so that sheets delivered by the sheet processing machine can be collected in the collecting tray of the processing machine.

In another embodiment of the invention the sorting units each are provided with a second conveyor system having a diverting means for selectively directing a sheet to the associated first conveyor system. The second conveyor systems are adapted for coupling to form a continuous conveyor path. Consequently, the sheet sorting device according to the invention can be built up from a number of completely identical units.

Preferably, a tray for collecting sheets is provided beneath the sorting unit and a diverting means is provided in the second conveyor system for each sorting unit. The diverting means is the second position of the second conveyor system can occupy two positions; in the first, a sheet is fed into the sorting unit and in the second, a sheet is fed into the collecting tray.

As a result the collecting tray can be made relatively large and at the same time is readily accessible for the removal of sheets collected therein.

Other features and advantages will be apparent from the following description of the present preferred embodiments of a sheet sorting device according to the invention with reference to the accompanying drawings.

PRESENTLY PREFERRED EMBODIMENT

Figure 1:
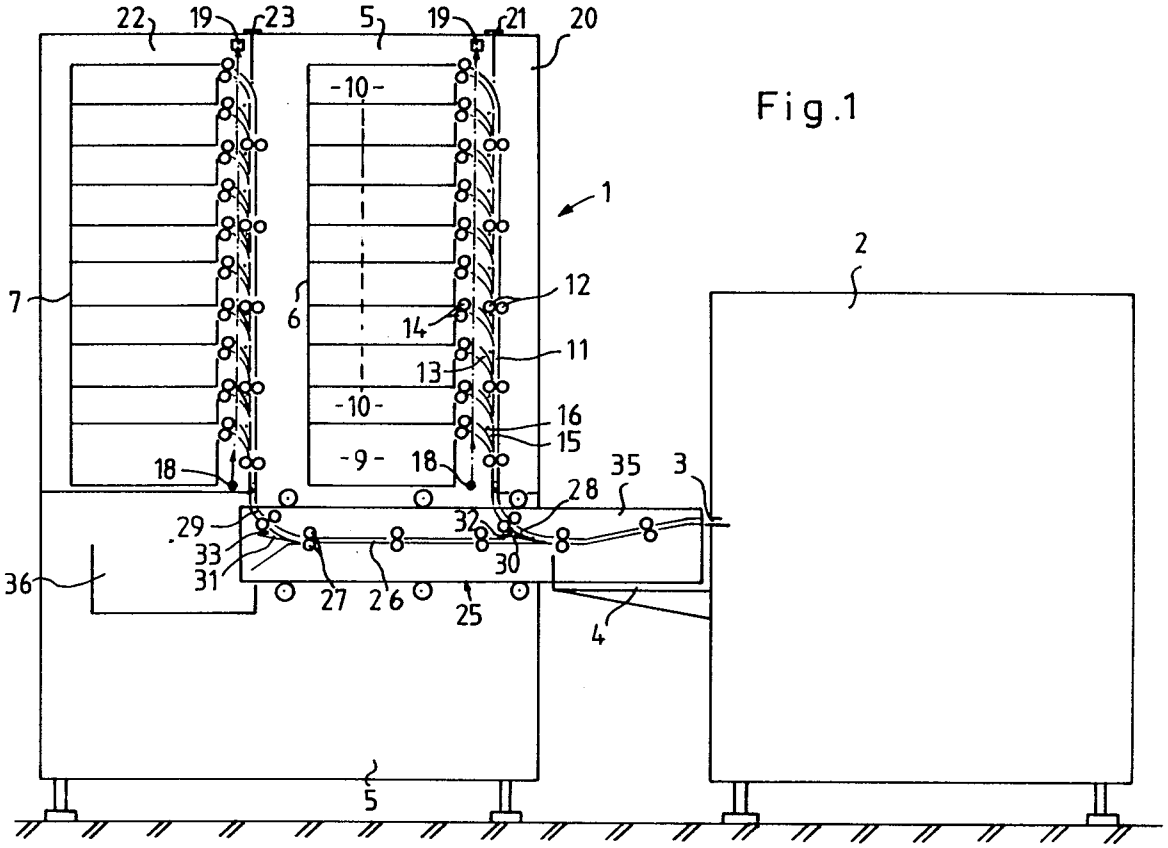
FIG. 1 is a front view of a sheet sorting device according to the present invention connected to a sheet processing machine.
Figure 2:
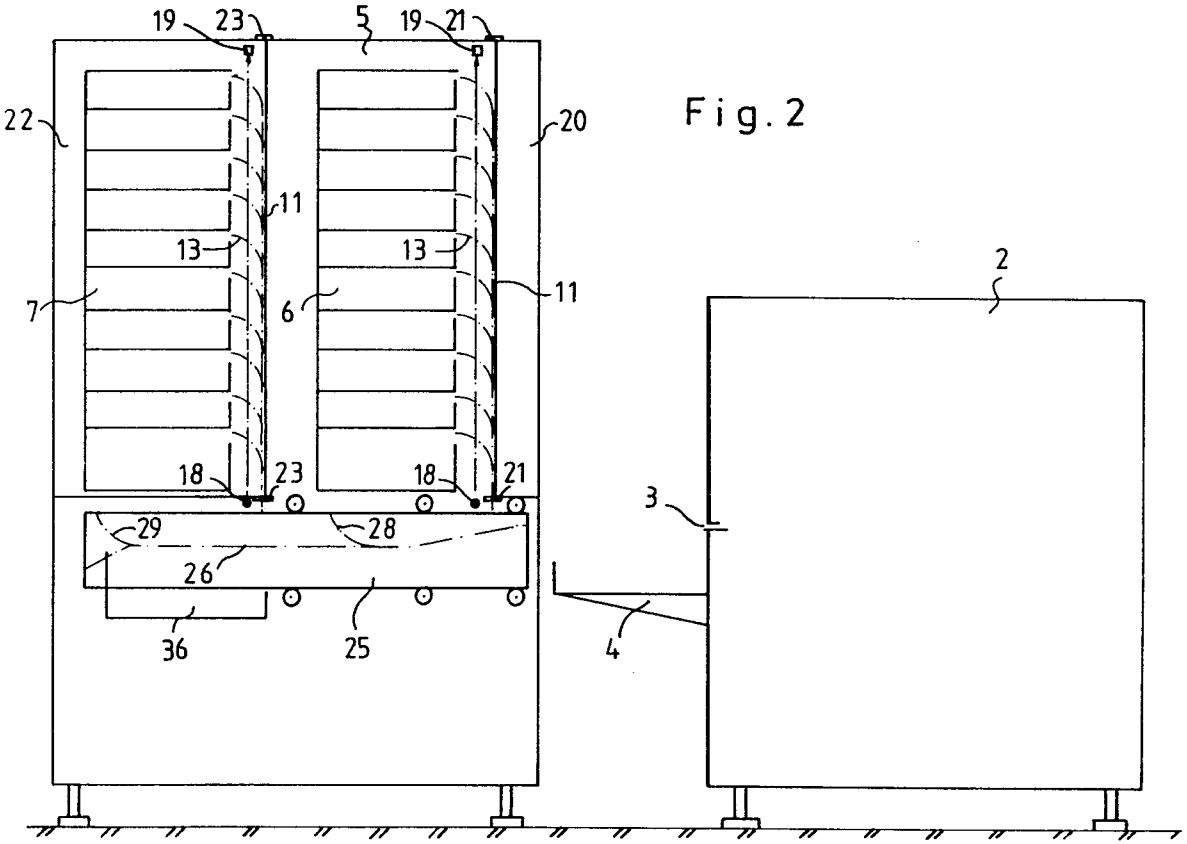
FIG. 2 is a front view of a sheet sorting device as shown in FIG. 1, but disconnected from the sheet processing machine.
Figure 3:
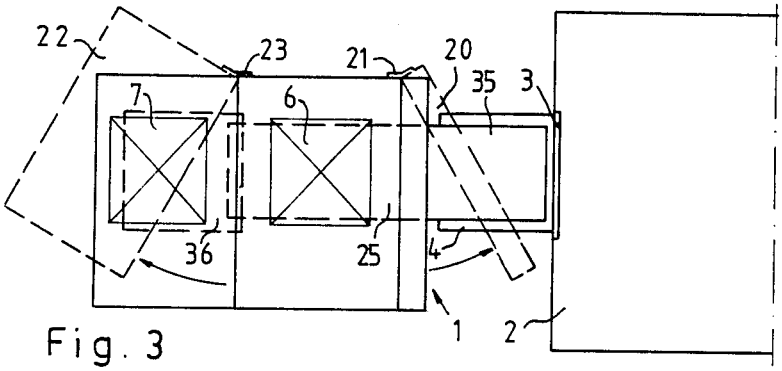
FIG. 3 is a top view of the sheet sorting device and the sheet processing machine as shown in FIG. 1.

Referring to FIGS. 1–3 sheet sorting device 1 is shown positioned next to a sheet processing device 2 such as a copying machine. Copying machine 2 is provided with an opening 3 through which printed, and possibly folded sheets are fed out of copying machine 2. In the absence of a sheet sorting device next to copying machine 2, the sheets are deposited in receiving tray 4 connected to the copying machine.

Two sorting units 6 and 7, respectively, are secured next to one another in frame 5 of the sheet sorting device 1. The units 6 and 7 are substantially identical in construction and each comprise a number, ten are shown, superposed receiving bins. Accordingly, only one of the units will be described in detail.

The lowest bin, bottom tray 9, of a unit is provided with a larger receiving capacity than the other trays denoted by 10. A first sheet conveyor path 11 is formed by associated guide plates extending vertically along trays 9 and 10. Driven conveyor roller pairs 12 are disposed at regular intervals along conveyor path 11 and for feeding a sheet upwardly in conveyor path 11.

Conveyor paths 13 are provided and extend between sheet conveyor path 11 and each receiving tray 9 and 10, respectively. A driven conveyor roller pair 14 is disposed in each conveyor path 13 and to advance a sheet in the associated path 13. At the junction of each conveyor path 13 and conveyor path 11, a deflector plate 15 is provided which, as shown in FIG. 1, is pivotable about pivot 16. When inoperative, the deflector plate is in a position that is situated completely outside the sheet conveyor path 11. Each deflector plate 15 can be set, by means not shown, e.g., a solenoid, into a position in which the deflector plate 15 projects into the sheet conveyor path 11 to deflect a sheet fed in path 11 to an associated adjoining path 13. Openings are formed in the guide plates forming the sheet conveyor paths 13 and together from a straight duct. At one end of the duct, a lamp 18 is disposed while a detector 19 is disposed at the other end of the duct, said detector being sensitive to the radiation of lamp 18 which radiation can be interrupted by a sheet in one of paths 13.

The means capable of actuating each deflector plate 15 are coupled to a control system (not shown), e.g., the control system of copying machine 2, for selective actuation of the deflector plates 15 in a way which will be explained hereinafter in connection with the description of the operation of the sheet sorting device.

The conveyor rollers of the conveyor roller pairs 12 situated on the outside of sorting unit 6 are rotatably secured in subframe 20 which is pivotably secured at point 21 to frame 5 (see FIG. 3). Excluding the rollers of the conveyor roller pairs 12 adjacent sorting unit 6, sorting unit 7 is secured in subframe 22 which is pivotably secured to frame 5 at point 23. Half of conveyor roller pairs 12 are fixedly mounted to frame 5 and are driven. Each of the other conveyor rollers mounted on hinged subframes 20 and 22, respectively, is biased by a spring against the associated driven roller with which it forms the roller pair.

Carriage 25 is secured to frame 5 of the sorting device 1 and is horizontally displaceable in the space beneath the sorting units 6 and 7. Guide plates 26 form a second conveyor in the carriage 25 which extends horizontally through the entire carriage and discharges on either side. Sheet conveyor rollers 27 are rotatably mounted in carriage 25 and may be driven by drive means (not shown) to feed a sheet through second conveyor guide path 26. Sheet conveyor path 26 is followed by two conveyor paths 28 and 29 which discharge at the top of the carriage 25. The distance between these discharge points is equal to the distance between the discharge points of the conveyor paths 11 at the bottom of the sorting units 6 and 7, respectively, so that the latter paths can simultaneously adjoin sheet conveyor paths 28 and 29.

Located where sheet conveyor paths 28 and 29 adjoin sheet conveyor path 26 are deflector plates 30 and 31, respectively, (seen in FIG. 1). Plates 30 and 31 are pivotable about axis 32 and 33, respectively. In the inoperative position, deflector plates 30 and 31 are situated completely outside sheet conveyor path 26. Selector means (not shown), e.g., a solenoid, can selectively place the plates into a position in which the associated deflector plate projects into the sheet conveyor path 26 to deflect a sheet in sheet conveyor path 26 to the associated sorting unit 6 or 7, respectively.

Carriage 25 is movable between two positions represented respectively in FIGS. 1 and 2 and in which positions the carriage 25 can be locked. Means (not shown) enable carriage 25 to be manually unlocked and moved to the other position in which the carriage is again locked. In the position shown in FIG. 1, sheet conveyor paths 11 in sorting units 6 and 7 adjoin the conveyor paths 28 and 29, respectively, and extension 35 of the carriage 25 projects outwardly from frame 5. In this position, that part of sheet conveyor path 26 which is situated in extension 35 of the carriage adjoins exit opening 3 of copying machine 2 disposed next to sorting device 1, and thus covers receiving tray 4 of copying machine 2.

Beneath the sorting unit 7 and beneath the space in which carriage 25 can move receiving tray 36 is secured to frame 5. When the deflector plates 30 and 31 are in the inoperative position, a sheet fed through conveyor path 26 by sheet conveyor rollers 27 is fed to tray 36.

In the position represented in FIG. 2, on the other hand, carriage 25 is completely beneath the sorting units 6 and 7, thus covering receiving tray 36. Sheet sorting device 1 is consequently disconnected from the copying machine 2. In this position sheets discharged from the copying machine 2 are deposited in receiving tray 4 of copying machine 2.

The operation of the sheet sorting device represented in FIGS. 1–3 is as follows:

Sheet sorting device 1 is set to sorting, collating or collecting by operation of appropriate controls on a control panel of copying machine 2. Initially, deflector plates 15 at receiving bins 9 and 10 in sorting units 6 and 7 are actuated by associated solenoids. Additionally, deflector plates 30 and 31 in the carriage 25 are actuated by the associated solenoid. The sheet sorting device can also be set to deposit sheets in sorting unit 6 or to deposit sheets in sorting unit 7.

When set to "sort," the copies discharged consecutively from the copying machine after being made from one original are deposited in consecutive bins, starting at bottom pin 9 of the unit which has been set up. This cycle is repeated after each change of original.

When set to "collate," the copy sheets consecutively discharged from the copying machine and associated with one and the same original are deposited in bottom bin 9 of the unit that has been set up. After each change of original the copy sheets discharged thereafter are deposited in the next bin.

When set to "collect," all of the copy sheets discharged from the copying machine are deposited in the bottom bin 9 of the sorting unit that has been set up.

When detector 19 detects that a sheet has not passed one of the sheet conveyor paths 13 leading to the receiving bins of a sorting unit 6 or 7, respectively, at the correct time the deflector plate 30 or 31, respectively, leading to the associated sorting unit is inactuated automatically. Sheets discharged thereafter from the copying machine are fed, via conveyor path 26, to sheet tray 36 and deposited therein. Sheets collected in tray 36 can be taken out of tray 36 from the front of the sheet sorting device or from the side of the sheet sorting device. When detector 19 signals a fault and sheets are fed to tray 36, the control system reports that a malfunction has occurred in one of the sorting units. The copying machine operator can correct the malfunction in the sheet sorting device and then carry on working with the sorting unit that has been set up.

If a disturbance occurs elsewhere in the sorting device, e.g., if a copy sheet jams in conveyor path 26 in carriage 25, it is nevertheless possible to continue copying rapidly. For this purpose, the carriage 25 is unlocked and pushed into the position in which the carriage is completely beneath the sorting units 6 and 7. Copy sheets discharged thereafter from the copying machine are collected in the collecting tray 4 of the copying machine.

Figure 4:
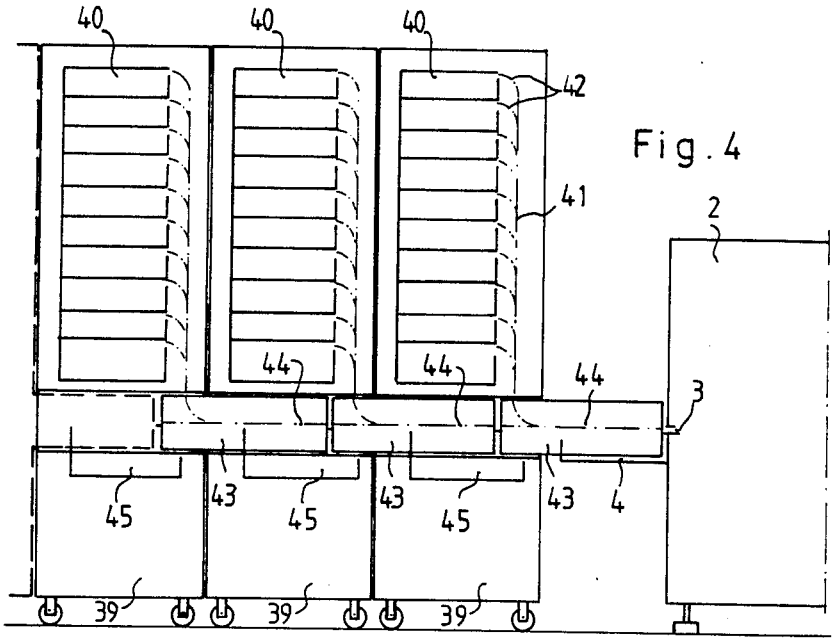
FIG. 4 schematically represents another embodiment of a sheet sorting device according to the invention.

The sheet sorting device represented diagrammatically in FIG. 4 consists of a number of completely identical sorting units 39. Each sorting unit 39 comprises a number of superposed bins 40 and conveyor path 41 situated adjacent the same and provided with deflector plates 42 for selectively depositing sheets in the bins 40. Each sorting unit 39 is provided with a carriage 43 movable between a position in which the carriage projects outside the sorting unit as represented in FIG. 4, and a position in which the carriage is completely beneath the bins 40. Each carriage 43 is provided with a conveyor path 44 extending horizontally through the carriage and a branch, accessible via a deflector plate, which in the extended position of the carriage adjoins the conveyor path 41 of the sorting unit. A receiving bin 45 is also provided in each unit beneath the carriage 43.

Unit 39 can be pushed against a copying machine 2 or against another unit 39, with the extension of carriage 43 fitting over receiving tray 4 of the copying machine or adjoining carriage 43 of the sorting unit 39 previously pushed up. The conveyor paths 44 through the carriages 43 of units pushed against one another form a continuous conveyor path. Therefore, a large number of sorters can be assembled for individual sorting devices.

While presently preferred embodiments have been shown and described in particularity, the invention may be otherwise embodied within the scope of the appended claims.

What is claimed is:

1. A sheet sorting device for use in a sheet processing machine comprising at least one sorting unit having a plurality of superposed sheet receiving bins and a first conveyor means for conveying sheets selectively to one of said sheet receiving bins and a second conveyor means positioned below and substantially normal to said first conveyor for conveying sheets from said processing machine to said first conveyor, said second conveyor means being moveably mounted to said sorting unit so as to be displaceable between a first position disposed below said receiving bins and a second position adjoining said sheet processing machine.

2. A sheet sorting device according to claim 1, wherein said sorting device comprises a plurality of sorting units, each of said sorting units having a second conveyor means including means for selectively diverting a sheet to an associated first conveyor means, each of said second conveyor means being adapted to connect with said other second conveyor means to form a continuous conveyor path.

3. A sheet sorting device according to claim 1 or 2, wherein a tray for collecting sheets is positioned beneath said sorting unit and a diverting means is provided in the second conveyor means for each of said sorting units, wherein said diverting means in a second position of said second conveyor means can occupy two positions, said first position being to feed a sheet into said sorting unit and said second position being to feed a sheet into said collecting tray.

4. A sheet sorting device according to claim 3, wherein each sorting unit includes a detection device for detecting a conveying fault in the path of said first conveyor means and means for controlling said diverter means in response to a conveying fault detected by said detection device, for diverting sheets subsequently supplied to said collecting tray.

5. A sheet sorting device according to claim 4, wherein a second detecting device is provided for detecting a conveying fault in the path of said second conveyor means including a control means which in response to a conveying fault detected by said second detection device move said second conveyor means or said second conveyor means associated with the sorting unit where the conveying fault has been detected and the second conveyor means associated with the sorting units situated further on as considered in the direction of conveyance from a second position to a first position.

6. A sheet sorting device according to claim 1, wherein a detection device is provided for detecting a conveying fault in the path of said second conveyor means including a control means which in response to a conveying fault detected by said detection device move said second conveyor means or said second conveyor means associated with the sorting unit where the conveying fault has been detected and the second conveyor means associated with the sorting units situated further on as considered in the direction of conveyance from a second position to a first position.

7. A sheet sorting device according to claim 2, wherein a detection device is provided for detecting a conveying fault in the path of said second conveyor means including a control means which in response to a conveying fault detected by said detection device move said second conveyor means or said second conveyor means associated with the sorting unit where the conveying fault has been detected and the second conveyor means associated with the sorting units situated further on as considered in the direction of conveyance from a second position to a first position.

8. A sheet sorting device according to claim 3, wherein a detection device is provided for detecting a conveying fault in the path of said second conveyor means including a control means which in response to a conveying fault detected by said detection device move said second conveyor means or said second conveyor means associated with sorting units where the conveying fault has been detected and the second conveyor means associated with the the sorting unit situated further on as considered in the direction of conveyance from a second position to a first position.

* * * * *

UNITED STATES PATENT AND TRADEMARK OFFICE

CERTIFICATE OF CORRECTION

PATENT NO. : 4,711,444

DATED : December 8, 1987

INVENTOR(S) : Geurts

It is certified that error appears in the above—identified patent and that said Letters Patent is hereby corrected as shown below:

In the Abstract, line 8: please insert "pivotably" after "is".
Column 2, line 19: please insert "and" after "system".
Column 3, line 13: please delete --from-- and substitute "form" therefor.
Column 3, line 54: please delete --,-- after "respectively"
Column 3, line 55: please delete --axis-- and substitute "axes" therefor.
Column 4, line 35: please delete --pin-- and substitute "bin" therefor.
Column 6, line 54: please delete --the the-- and substitute "the" therefor.

Signed and Sealed this

Twenty-seventh Day of September, 1988

*Attest:*

DONALD J. QUIGG

*Attesting Officer* *Commissioner of Patents and Trademarks*